US006145569A

United States Patent [19]

Shaw et al.

[11] Patent Number: 6,145,569

[45] Date of Patent: Nov. 14, 2000

[54] ARCHED WINDOW BLIND

[76] Inventors: Trevor Shaw, 158-230 Butt Road; Eric R. McLellan, 413-230 Butt Road, both of Westbank, British Columbia, Canada, V4T 2L3

[21] Appl. No.: 09/343,555

[22] Filed: Jun. 30, 1999

Related U.S. Application Data

[60] Provisional application No. 60/091,720, Jul. 6, 1998.

[51] Int. Cl.[7] ..... E06B 3/48

[52] U.S. Cl. ..... 160/84.07; 160/134

[58] Field of Search ..... 160/84.07, 134

[56] References Cited

U.S. PATENT DOCUMENTS

| | | | |
|---|---|---|---|
| 602,967 | 4/1898 | Wells | 160/134 |
| 1,609,877 | 12/1926 | Kendall | 160/84.07 |
| 1,808,652 | 6/1931 | Gump | 160/84.07 |
| 4,699,195 | 10/1987 | Lester | 160/134 |
| 4,858,669 | 8/1989 | Vinson | 160/134 |
| 5,002,112 | 3/1991 | Schnebly et al. | 160/84.1 |
| 5,010,939 | 4/1991 | King | 160/84.1 |
| 5,044,418 | 9/1991 | Donahue | 160/330 |
| 5,050,661 | 9/1991 | Sikkema et al. | 160/84.1 |
| 5,092,383 | 3/1992 | Niemeijer et al. | 160/84.1 |
| 5,139,070 | 8/1992 | Kidd | 160/84.1 |
| 5,168,912 | 12/1992 | Jelic et al. | 160/84.1 |
| 5,183,092 | 2/1993 | Jelic | 160/84.1 |
| 5,537,780 | 7/1996 | Cleaver et al. | 49/82.1 |
| 5,584,329 | 12/1996 | Thomas | 160/134 |
| 5,598,883 | 2/1997 | Platsis | 160/84.07 |
| 5,813,448 | 9/1998 | Levy | 160/134 |

*Primary Examiner*—Blair M. Johnson
*Attorney, Agent, or Firm*—Anthony C. Edwards

[57] ABSTRACT

An arcuately deployable blind for arched frame windows includes a base, a pivot mounted to the base and positionable over a center of curvature of a window frame of the arched frame window, and a slide arm, rotatably mounted at first end to the pivot. An arcuate guide secured to the base. An arcuately deployable pleated blind has first and second parallel longitudinal sides and first and second parallel transverse edges. The edges extend generally at right angles to, and contiguous with the sides. A follower on the pleated blind is in sliding cooperation with the guide. The first edge of the blind is fastened to the base. The second edge of the blind is slidably fastened to the slide arm. An actuator deploys and retracts the blind.

26 Claims, 10 Drawing Sheets

18
18b
48b
50
D
18b
B
C
F
E
38
26
28
40
22b
24
64
46b
20
18a
22a
46a
36
30
32
16
36

18c
34b
32
30
36
18c
36
26
24
20

3
4
64
66
40
40a
26
28
30
32
36
34a
34b
38
18b
18c
3
4

52b
18
52a
52a
52b
52
32
18
52

26
28
42
42
30

24

44
44
24
20

ARCHED WINDOW BLIND

CROSS REFERENCE TO RELATED APPLICATION

This application claims priority from U.S. Provisional patent application No. 60/091,720 filed Jul. 6, 1998 titled Arched Window Blind.

FIELD OF THE INVENTION

This invention relates to the field of window coverings, and in particular window coverings in the nature of retractable blinds adapted for use in arched window.

BACKGROUND OF THE INVENTION

A common architectural feature found particularly in residential homes is the vaulted ceiling. The vaulted ceiling is desirable in that it removes the claustrophobic nature of rooms such as formal sitting rooms and dining rooms which have a limited floor area as is commonly the case in many new housing developments where the amount of square footage of a dwelling is at a premium to the land developer. The sense of openness evoked by a vaulted ceiling is enhanced if tall windows are employed to take advantage of the higher than normal elevated walls, typically where a vaulted ceiling apex intersects a room wall. It is now well accepted that on such walls windows may be extended vertically by the use of correspondingly sized arched windows, that is, windows contained within generally semi-circular arched frames.

In the prior art, attempts have been made to provide retractable window blinds for use within such arched frames, none of which exhibiting the advantages of the present invention. A problem not properly addressed in the prior art is that in conventional arched windows, the centre of curvature of the window frame falls below the upper surface of the window sill. This occurs because, generally, the window frame is formed into a semi-circle, and the window sill having a discrete thickness is mounted between the opposite ends of the semi-circular arch thereby covering the center of curvature.

SUMMARY OF THE INVENTION

In summary, the blind for an arched window of the present invention is for installation into an arched window having a semi-circular window frame and a horizontal window sills wherein the window frame has a center of curvature lying at or below an upper surface of the window sill.

The blind includes a base mountable onto the upper surface of the window sill. A pivot is mounted onto the base so as to be positionable a first distance, vertically above the center of curvature of the window frame when the base is mounted onto the window sill. An arm is pivotably mounted to the pivot so as to be pivotable 180 degrees about the pivot in a vertical plane. The vertical plane intersects the base. An accordion member such as a pleated blind, or other folding cover extendible for example in a fan-like deployment, is mounted between the arm and the base. The accordion member is collapsible and extendible between a base edge of the accordion member and a leading edge of the accordion member by collapsing into a stowed position and unfolding into a deployed position respectively a folded adjacent array of elements extending between the base edge and the leading edge. The base edge is mountable to a first side of the upper surface of the window sill, where the first side of the upper surface of the window sill extends between the pivot and a first end of the window frame when the base is mounted to the window sill. The leading edge of the accordion member is slidably mounted to the arm so as to be slidable relative to the arm in a radial direction, radial relative to the pivot.

A guideway is mounted to the base. A guideway follower on the accordion member cooperates with the guideway so as to radially position, along an arcuate trajectory relative to the pivot and the arm, the leading edge and the folded adjacent array of elements as the arm is rotated about the pivot in the vertical plane. As the leading edge follows the arcuate trajectory, a radially outermost end of the leading edge is a maximum radial distance from the pivot when the leading edge is horizontal and is a minimum radial distance from the pivot when the leading edge is vertical. The maximum radial distance is greater than the minimum radial distance by a distance equal to the first distance. Thus, the blind may be opened and closed without binding of the blind at the apex of the window frame.

A support is mountable to the base for supporting the pleated blind while in the deployed position. The support may be a curved elongate member such as a flexible rod mountable at its ends to the base.

In one embodiment the guideway is an arcuate track mounted at ends of the track to the base and parallel to the vertical plane. The guideway follower is a rigid member mounted to the leading edge of the pleated blind and extending generally perpendicularly from the vertical plane so as to slidingly engage an end of the rigid member in the track. The track may also serve as the support.

Advantageously, the base is an elongate channel and the vertical plane intersects the channel along its length.

In one aspect of the present invention, the channel is a telescopic channel, adjustable so as to abut ends of the channel against the first end of the window frame and against an opposed facing second end of the window frame.

In a further aspect, the pivot is adjustably positionable vertically on the base.

Further advantageously, the leading edge includes a slat mounted to an adjacent end element in the array so as to be parallel and adjacent the arm.

In an alternative embodiment, the guideway is an arcuate bridgeway mounted over the pivot on the base. The bridgeway lies in the vertical plane. In this embodiment, the follower is a radially innermost end of the leading edge and a radially innermost edge of the array of elements. The bridgeway is positioned for sliding engagement of the radially innermost end of the leading edge and the radially innermost edge of the array of elements over an upper surface of the bridgeway as the arm is pivoted between the stowed position and the deployed position.

In a further description, the arcuately deployable blind for arched frame windows of the present invention may be described as including a base, a pivot mounted to the base and positionable over a center of curvature of a window frame of the arched frame window, and a slide arm, rotatably mounted at first end to the pivot. An arcuate guide secured to the base. An arcuately deployable pleated blind has first and second parallel longitudinal sides and first and second parallel transverse edges. The edges extend generally at right angles to, and contiguous with, the sides. A follower on the pleated blind is in sliding cooperation with the guide. The first edge of the blind is fastened to the base. The second edge of the blind is slidably fastened to the slide arm. An actuator is provided for deploying and retracting the blind.

DETAILED DESCRIPTION OF PREFERRED EMBODIMENTS

Figure 1:
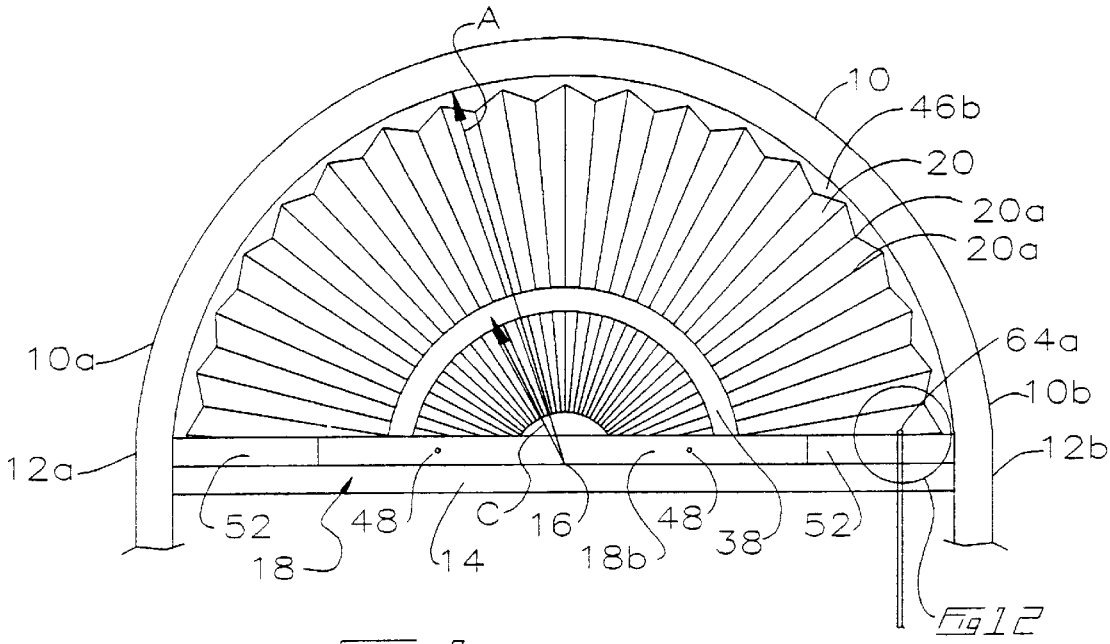
FIG. 1 is, in front elevation view, the arched window blind of the present invention, with blind deployed.
Figure 2:
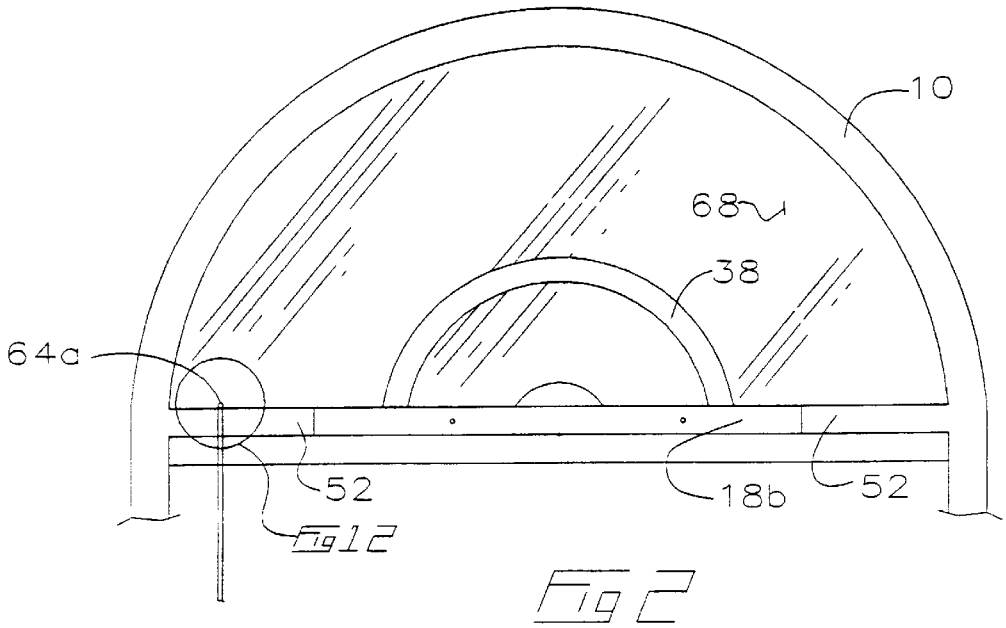
FIG. 2 is, in front elevation view, the arched window blind of FIG. 1 with blind retracted.

The arched window blind of the present invention is illustrated in its deployed position in FIG. 1 and in its fully retracted position in FIG. 2. Arched window frame 10 extends in a semi-circle between vertical frame members 12*a* and 12*b*. Horizontally disposed window sill 14 extends between the opposite ends 10*a* and 10*b* of arched window frame 10, and is rigidly mounted thereto. Arched window frame 10 is an arcuate member, preferably semi-circular, having a center of curvature 16. In the instance where arched window frame 10 is exactly semi-circular, radius A has a constant length Radius A sweeps out the radial sector of the arch between opposite ends 10*a* and 10*b* of arched window frame 10.

Figure 3:
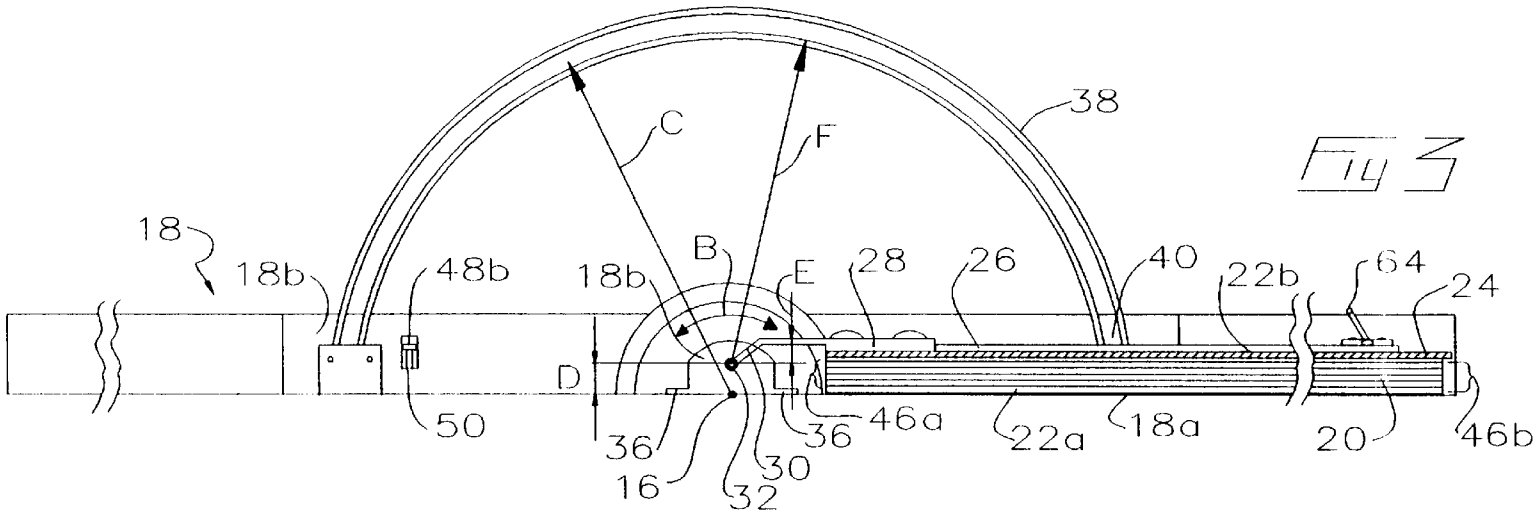
FIG. 3 is, in partially cut-away front elevation view, the operating arm and arm track of the arched window blind of FIG. 1 in sectional view along line 3—3 in FIG. 5.
Figure 4:
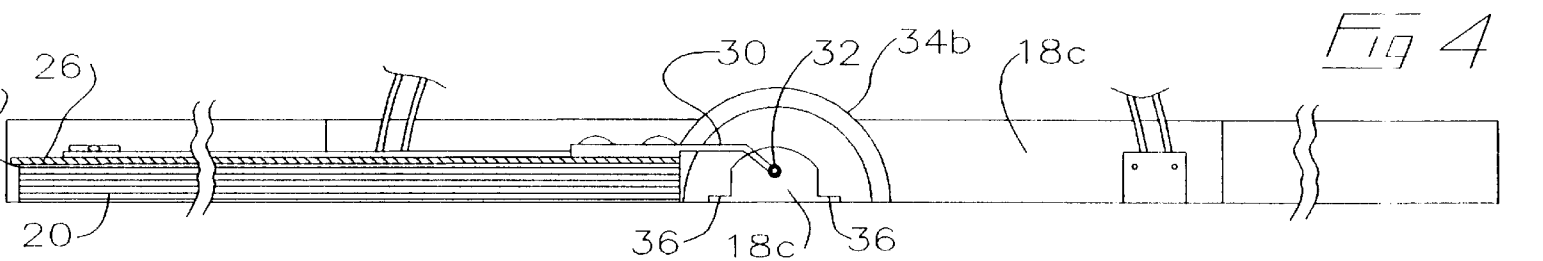
FIG. 4 is, a cross-sectional view along 4—4 in FIG. 5.
Figure 5:
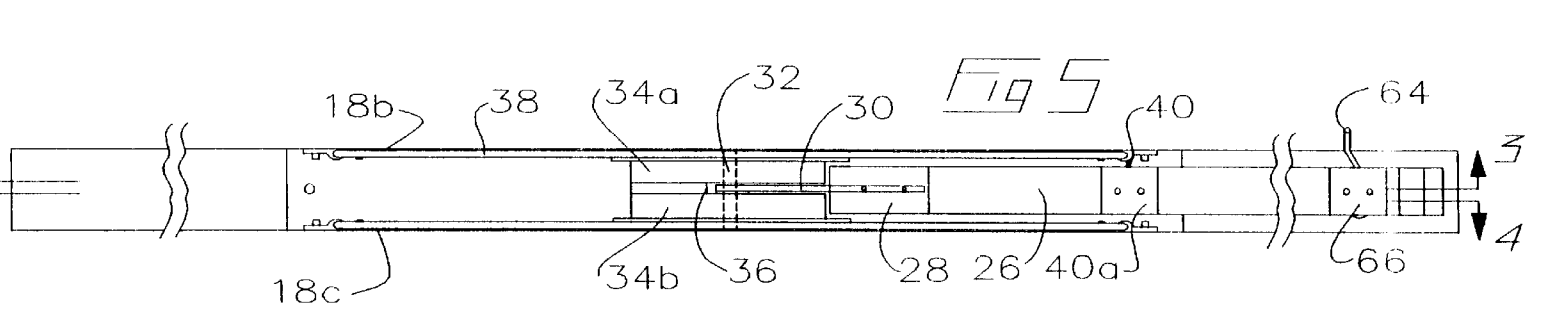
FIG. 5 is, in partially cut-away plan view, the arched window blind of FIG. 1.

Window blind channel member 18 better seen in FIGS. 3–5, is rigidly mounted onto the upper surface of window sill 14 so as to be juxtaposed therealong. Channel member 18 defines a longitudinal groove extending the longitudinal length of the channel. Pleated blind 20, which may be of stiff or otherwise reinforced fabric, or pleated plastic, cardboard or stiff paper or combinations of the above, or of other appropriate material known in the art in the manufacture of pleated blinds, is stored when in its retracted filly collapsed position within one end of channel member 18.

Pleated blind 20, when laid flat, is generally rectangular and defined by opposed first and second ends (the short sides of the rectangle), and first and second opposed longitudinal sides (the longer sides of the rectangle). Pleated blind 20 is pleated by means of pleat lines 20*a* extending in equally spaced parallel array along the length of pleated blind 20 parallel to the first and second ends of pleated blind 20 when the blind is laid flat.

Figure 6:
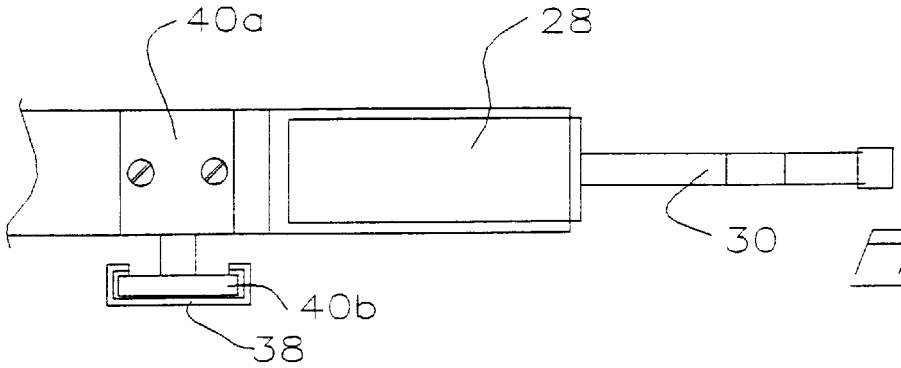
FIG. 6 is, in partially cut-away enlarged plan view, the operating arm and slide assembly of the arched window blind of FIG. 1.
Figure 7:
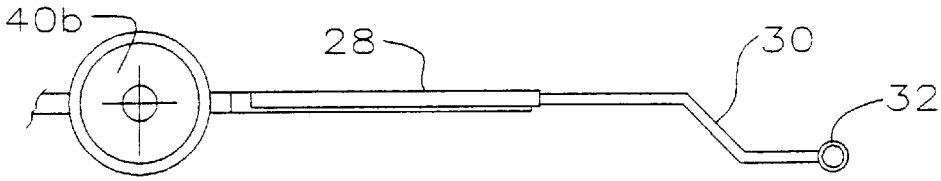
FIG. 7 is, in side elevation view, the operating arm and slide assembly of FIG. 6.
Figures 8, 8A, 8B, 8C, 9:
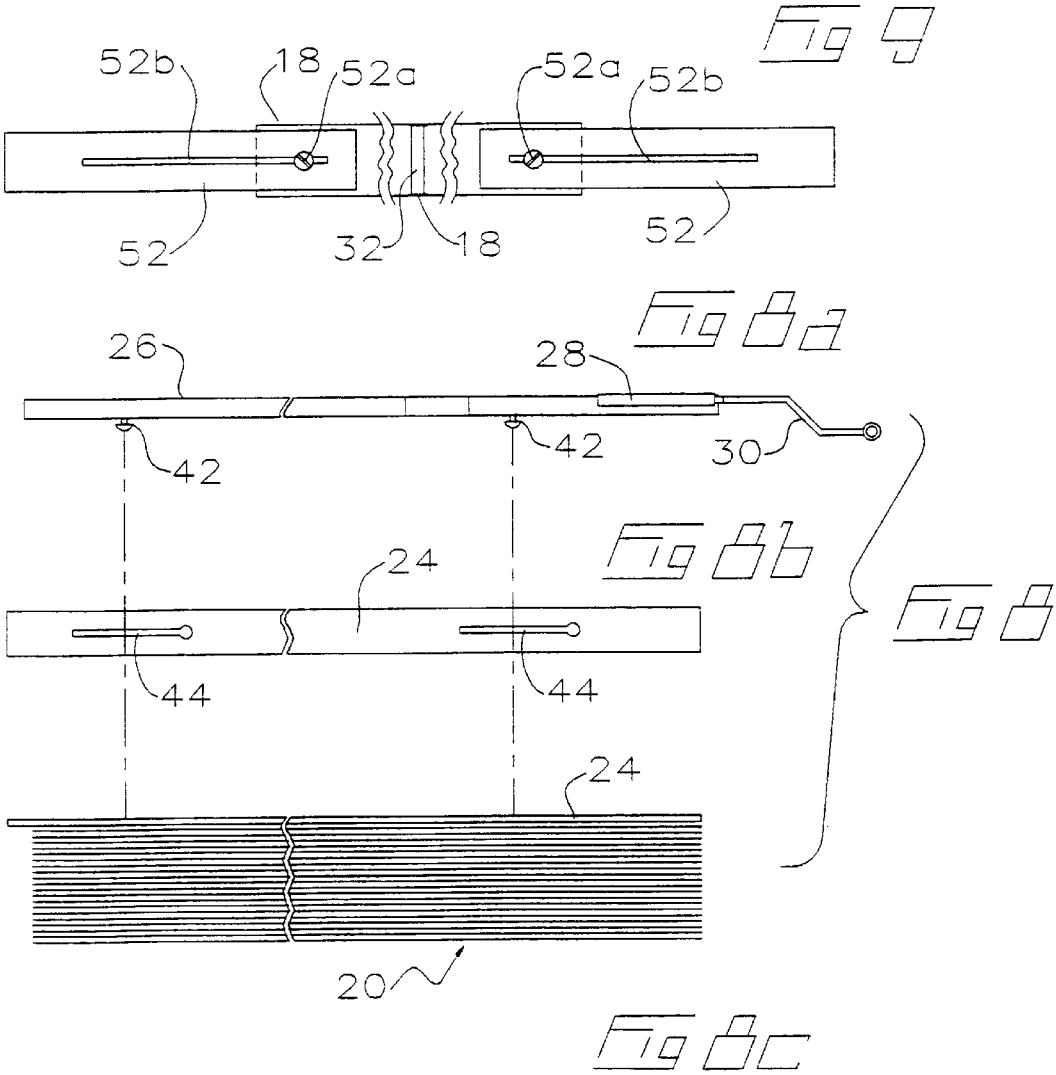
FIG. 8*a* is, in side elevation partially cut-away view, the operating arm, slide and slide arm of the arched window blind of the present invention.
FIG. 8*b* is, in partially cut-away plan view, the blind slat of the arched window blind of the present invention.
FIG. 8*c* is, in partially cut-away side elevation view, the blind slat and retracted window blind of the arched window blind of the present invention.
FIG. 9 is, in partially cut-away plan view, the slidably adjustable window blind channel of the arched window blind of the present invention.

Pleated blind 20 is collapsed in the normal fashion of pleated blinds so as to leave the opposed first and second ends 22*a* and 22*b* respectively available for mounting into channel member 18. In particular, first end 22*a* of blind 20 is securely mounted to the bottom interior surface 18*a* of channel member 18 and the opposite end, being second end 22*b*, of pleated blind 20 is securely mounted to blind slat 24. Advantageously, blind slat 24 extends the length of second end 22*b* of pleated blind 20. In one embodiment, as illustrated in FIG. 8, blind slat 24 may be slidably mounted to the underside of operating arm 26 and operating arm 26 rigidly mounted to slide arm 30. In another embodiment, as illustrated in FIGS. 5–7, operating arm 26 may be slidably mounted within slide 28 on slide arm 30. Thus, blind 24 may be either rigidly or slidably mounted to the underside of operating arm 26, so long as relative movement between pleated blind 20 and slide arm 30 is provided for. Slide arm 30 is pivotally mounted between opposed side walls of channel member 18 by means of pivot pin 32 journalled in, so as to extend between, lower blind supports 34*a* and 34*b* mounted in opposed facing relation to channel side walls 18*b* and 18*c* of channel member 18. The spaced apart relation between lower blind support 34*a* and lower blind support 34*b* is maintained by spacers 36.

Opposed facing lower blind supports 34*a* and 34*b* form a radial guide channel therebetween so as to guide slide arm 30 as it rotates about pivot pin 32 in direction B. Rotation of slide arm 30 in direction B deploys or retracts pleated blind 20 between its stowed position illustrated in FIGS. 2–5 and its deployed position illustrated in FIG. 1.

The arcuate path travelled by second end 22*b* of blind 20 as blind 20 is deployed from its stowed position, is dictated by the shape of track 38. Following arm 40 is rigidly mounted to operating arm 26 by means of following arm bracket 40*a* and roller 40*b* or other following means, better seen in FIGS. 6–7. Rotation of slide arm 30 in direction B about pivot pin 32 causes following arm 40 to follow the translation path defined by track 38. Track 38 is formed as a semi-circle having a radius C about center of curvature 16.

Because it is desirable to retrofit the arched window blind of the present invention into conventional arched windows, channel members 18 must, as described above, be mounted onto the upper surface of the existing window sill 14. Consequently, there exists a vertical offset distance D between pivot pin 32 and center of curvature 16. Depending on the thickness of pleated blind 20 when fully retracted into channel member 18 slide arm 30 may, as illustrated, have a dogs-leg offset or be otherwise curved to account for a further vertical displacement E between pivot pin 32 and blind slat 24.

Where window frame 10 is semi-circular, that is, radius A is a constant radius, track 38 is also semi-circular and radius C is also of constant radius. Where window frame 10 is arcuate so as to, for example, deviate from strictly semi-circular, that is, so that radius A is not constant, track 38 is correspondingly arcuate so that changes in the length of radius A are reflected in corresponding changes in the length of radius C as radii A and C sweep out a 180 degree sector about center of curvature 16, between opposite ends of channel member 18, in a vertical plane containing the longitudinal axis of channel member 18.

Thus as may be seen best in FIG. 3, as slide arm 30 is rotated about pivot pin 32 in direction B, the translation path of second end 22*b* of blind 20 relative to pivot pin 32 is governed by following arm 40 following in track 38. Because of the vertical offset D of pivot pin 30 relative to center of curvature 16, the length of radius F, that is, the radius extending from pivot pin 32 to the center of the path followed by following arm 40 in track 38 is nonconstant. In particular, the length of radius F when vertical is less than the length of radius F when generally horizontal. Thus the requirement that operating arm 26 is slidingly mounted to slide arm 30 or that blind slat 24 is slidably mounted to operating arm 26.

As better seen in FIG. 8, which is an exploded view of the slide arm, blind slat, and blind assembly, the sliding relative movement of blind 20 relative to slide arm 30 is accomplished by means of keys 42 which may be screws or bolts, mounted to operating arm 26 slidingly cooperating with corresponding keyways 44 in blind slat 24. Keyways 44 may be slots longitudinally aligned with elongate blind slat 24 so that keys 42 are free to slide along the longitudinal slots. Thus as following arm 40 sweeps out its arcuate translation path along track 38, radius F corresponding to the distance between pivot pin 32 and following arm 40 is free to vary to account for vertical displacement D as described above because of the relative sliding movement between operating arm 26 and blind slat 24.

In order to accommodate a smooth deployment of blind 20 in direction B, blind 20 may be adjusted once deployed so that the spacing between the radially distal edge of blind 20, that being second longitudinal side edge 46*b* opposed to first longitudinal side edge 46*a* of blind 20, and the radially innermost surface of window frame 10 is constant. Thus, adjusting screws 48*a* and their corresponding adjusting screw nuts 48*b* may be adjustably secured within a vertical adjustment track provided by adjusting slot 50 on side wall 18*b* of channel member 18. Thus with blind 20 trimmed to snugly fit between the inner surfaces of opposite ends 10*a* and 10*b* of window frame 10, the length of radius F at the vertex of window frame 10 may be adjusted so that blind 20, and in particular longitudinal side edge 46*b*, smoothly and snugly slides within frame 10 by adjusting track 38 vertically.

Where window sill 14 is longer than channel member 18, extension pieces or members 52 are adjustably securably mounted to the opposite ends of channel member 18 as for example by means of mounting screws 52*a* journalled in sliding engagement in adjusting slots 52*b* as better seen in FIG. 9.

Figure 10:
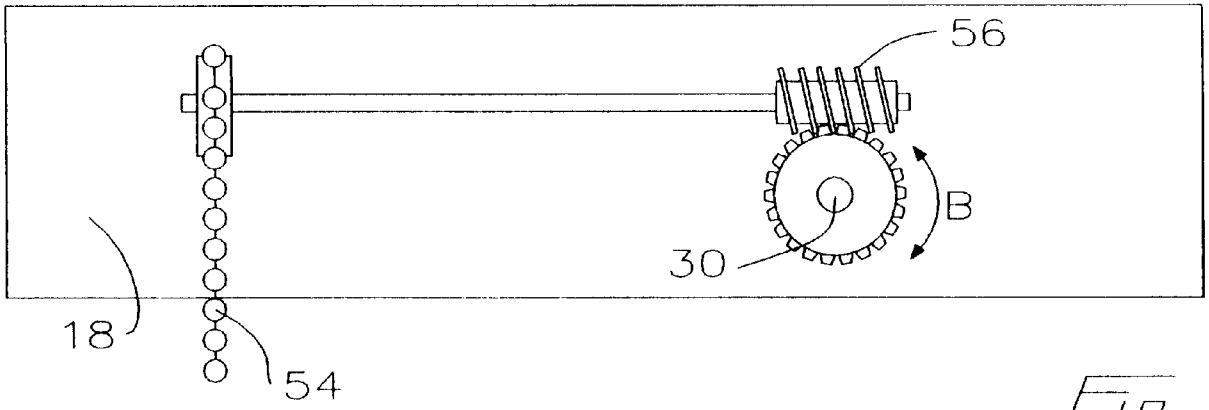
FIG. 10 is, in front elevation view, a pull chain and gear drive assembly for operating the deployment and retraction of the arched window blind of the present invention in a first embodiment.
Figure 13:
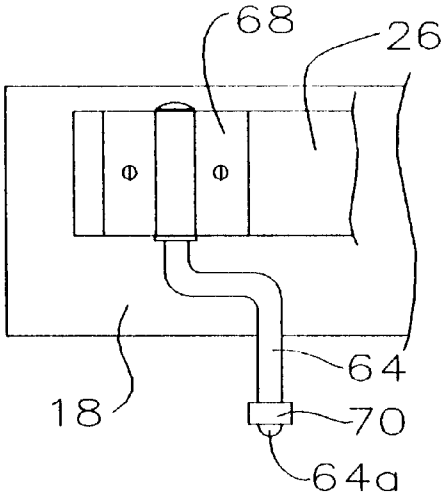
FIG. 13 is, in plan view, the rod and linkage of FIG. 12.
Figure 12:
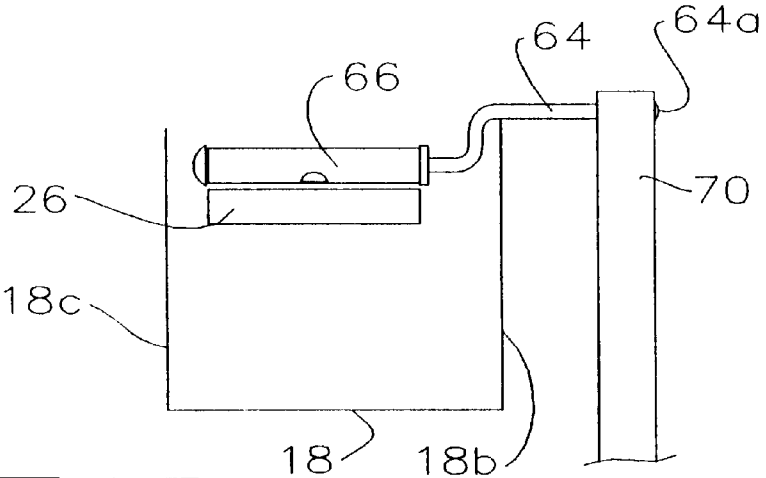
FIG. 12 is, in partially cut-away end elevation view, a rod and linkage for deploying and retracting the arched window blind of the present invention in a third embodiment.

As better seen in FIGS. 10–13, deployment of blind 20 in direction B may be accomplished by various means of rotating operating arm 26 about pin 32. For example, as seen in FIG. 10, a pull chain 54 may be employed to rotate a shaft mounted worm gear 56. Worm gear 56 rotates drive sprocket 58 which is rigidly mounted to a pivot arm such as slide arm 30.

Figure 11:
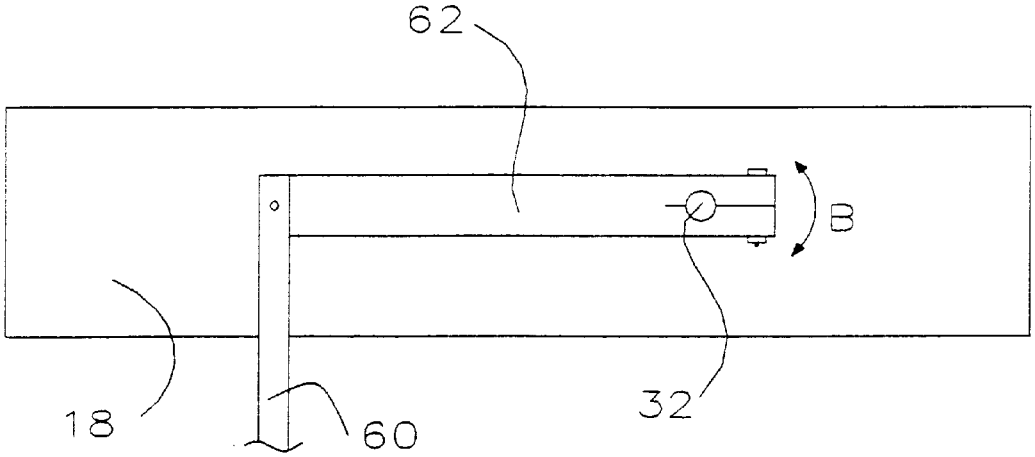
FIG. 11 is, in partially cut-away front elevation view, a pull rod and lever arm drive assembly for deploying and retracting the arched window blind of the present invention in a second embodiment.
Figure 14:
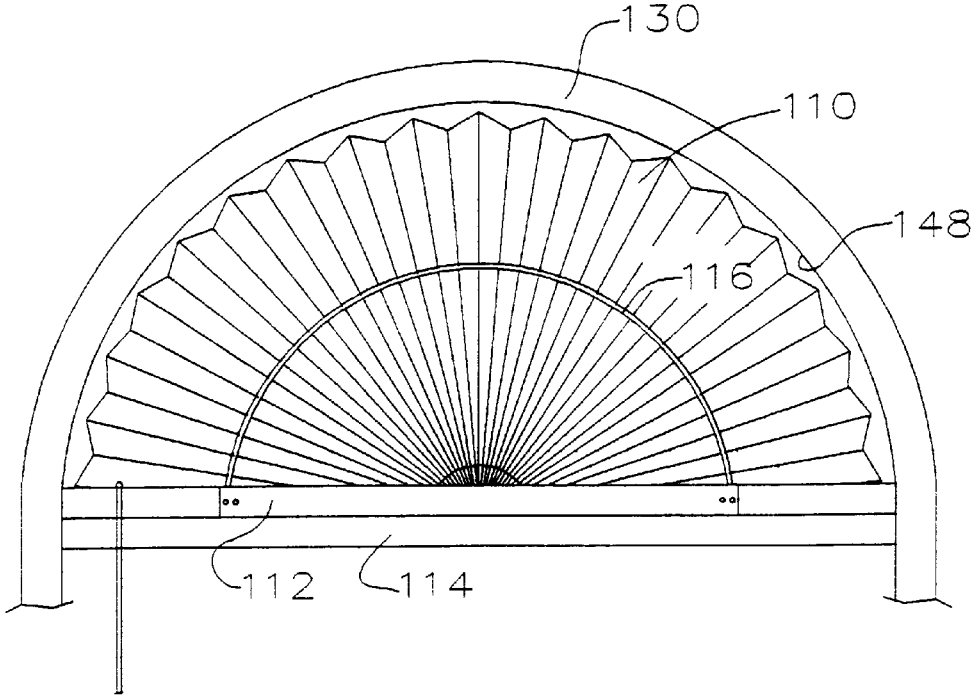
FIG. 14 is, in front elevation view, a modified arched window blind of the present invention, with blind deployed.
Figure 15:
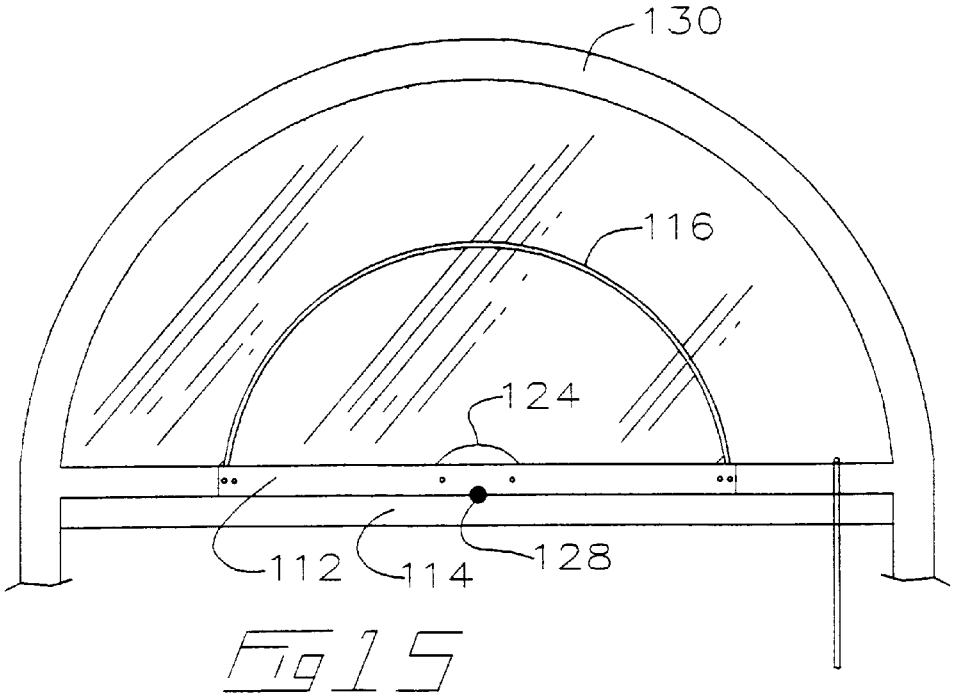
FIG. 15 is, in front elevation view, the arched window blind of FIG. 1 with blind retracted.
Figures 16, 17, 18:
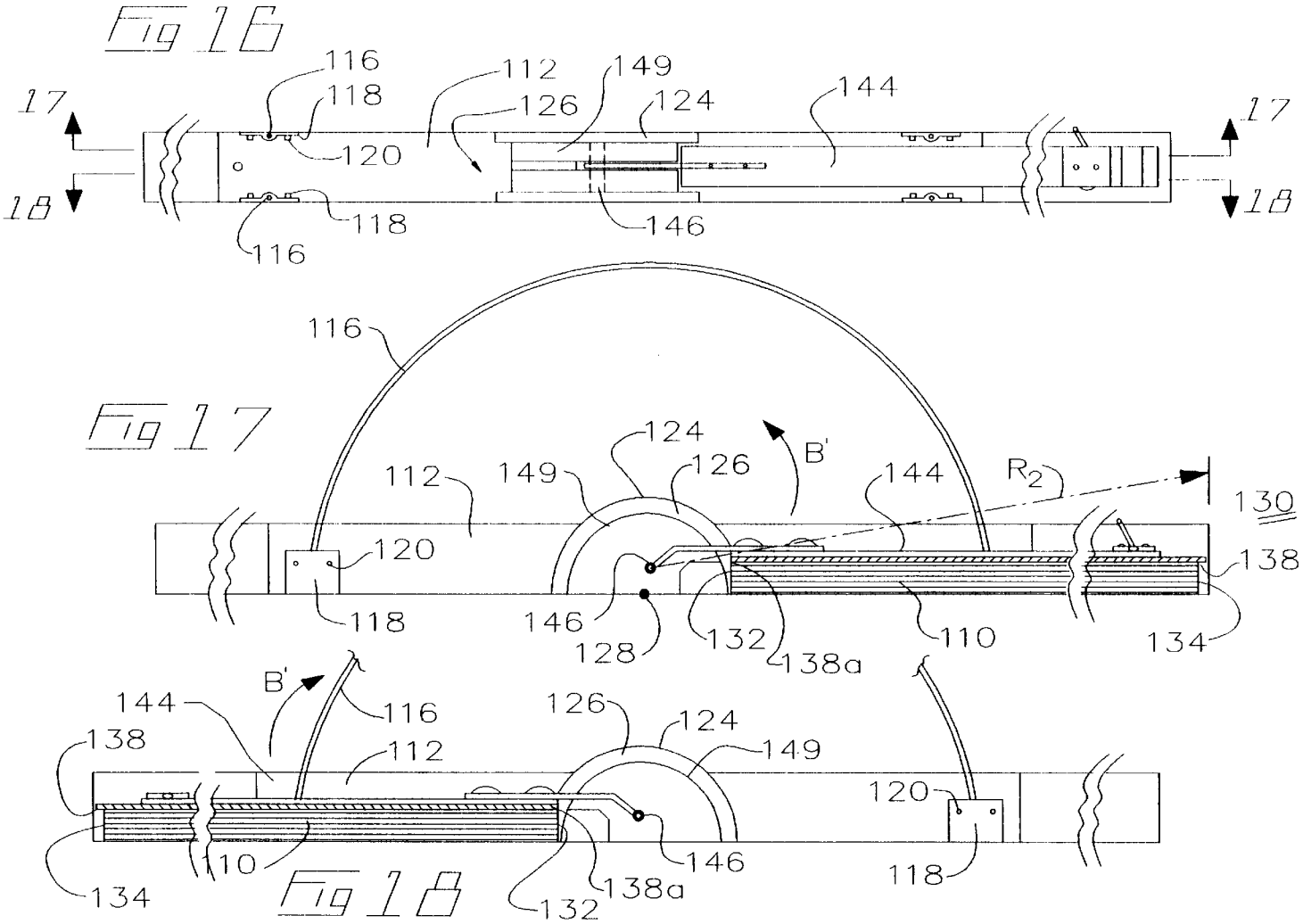
FIG. 16 is in enlarged partially cut-away plan view, the arched window blind of FIG. 1.
FIG. 17 is a cross sectional view along 17—17 of FIG. 16.
FIG. 18 is a cross sectional view along 18—18 of FIG. 16.

Alternatively, as seen in FIG. 11, pull rod 60 is pivotally mounted to lever arm 62 so that vertically pulling or pushing on pull rod 60 rotates lever arm 62, thereby rotating pivot pin 32 to which lever arm 62 is rigidly mounted. Rotating pivot pin 32 rotates slide arm 30 (not shown) in direction B so as to deploy or retract blind 20.

Alternatively, as better seen in FIGS. 3–5 and 12–13, an offset cantilevered arm 64 is rotatably mounted to the upper surface of the radially distal end of operating arm 26 by means of bracket 66. The outwardly cantilevered end 64*a* of cantilevered arm 64, which is understood would be cantilevered outwardly of operating arm 26 away from window 68, is pivotally mounted to an upper end of push rod 70. As may be appreciated from FIG. 12, cantilevered 64 is offset so as to allow retraction of operating arm 26 beneath the upper edges of side wall 18*b* on channel 18 so that, when blind 20 is fully retracted, its operating mechanism may not be viewed from the interior of the room as may be appreciated in FIG. 2. Manual translation of the upper end of push rod 70 in direction B deploys or retracts blind 20.

Illustrated in FIGS. 14 through 22 is an alternative embodiment of the arched window blind of the present invention. Window blind channel 112, is mounted to the upper surface of window sill 114. Channel 112 supports inner and outer parallel blind guides 116. Guides 116 may be flexible rods bent into a semi-circular curve and mounted at their ends to the inner faces of opposed vertical sides of channel 112, for example by clips 118. Clips 118 may be attached to channel 112 by means of sheet metal screws 120, or the like. Guides 116 serve to maintain lateral stability, relative to the longitudinal axis of channel 112, of pleated blind 110 during its travel from a fully stowed position seen in FIG. 15 to a fully deployed position seen in FIG. 14, and also in the reverse direction. The guide 116 positioned closest to the window glazing, may be dispensed with where the window sill is narrow. In these cases the window will act as the guide.

Mounted centrally of blind channel 112 is an arcuately shaped bridge 124. Bridge 124 contains a window blind guideway 126, the radial center 128 of which is generally coincident with the center of the semi-circular window frame 130. Window blind guideway 126 acts as a guide for a first, inner end 132 of blind 110. A second, outer end 134 of blind 110 is positioned in proximity to the inner surface of semi-circular window frame 130. Blind 110 extends between its inner and outer ends.

Blind channel 112 is adjustable to suit various window frame widths and blind lengths. As the length of the window blind varies to accommodate different sizes, arcuately shaped bridge 124 may be raised or lowered relative to the bottom of channel 112 by means of adjustment holes 122 to ensure that the blind does not bind at the apex of its travel against the apex of window frame 130.

Figure 19:
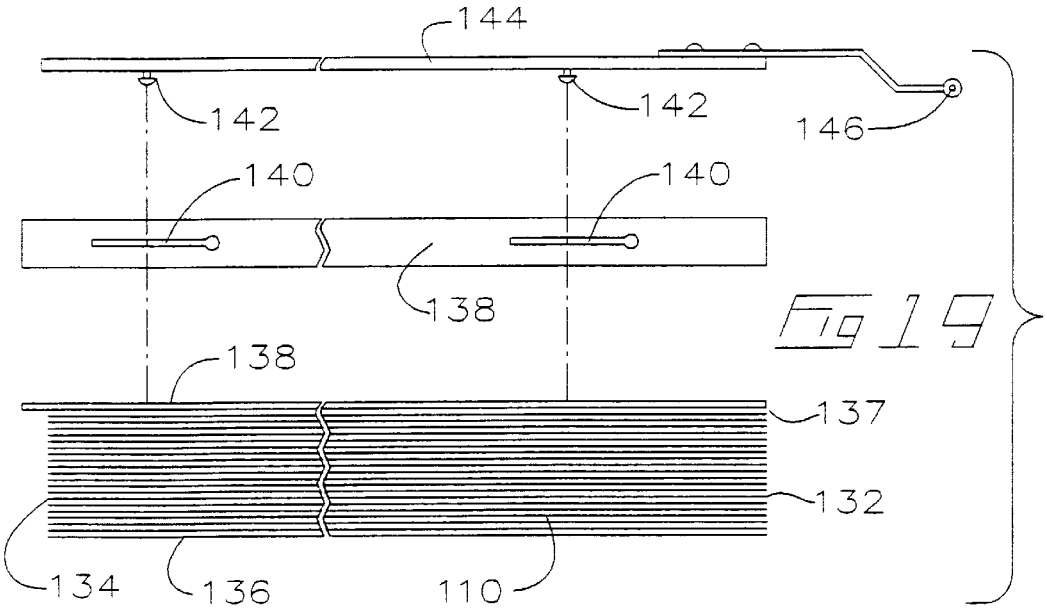
FIG. 19 is in exploded side elevation, the components of the self adjusting feature of the arched window blind of FIG. 1.

With reference to FIG. 19, a side 136 of pleated blind 110 is attached to channel 112. The opposing side 137 of blind 110 is attached to a slat 138. Slat 138 is made from heavier material than pleated blind 110, for example plastic or wood lath, and is of a width to nest freely within window blind guideway channel 126 of bridge 124. Slat 138 has slots 140 formed near each end of the slat. Slots 140 accept in sliding engagement therealong pins 142 mounted on operating arm 144 so as to slidably mount slat 138 on to operating arm 144.

Operating arm 144 is pivotally mounted to arcuately shaped bridge 124 at pivot point 146 which is located a distance D' from the radial center 128 of the semi-circular window frame 130. The radial distance $R_1$ from pivot point 146 to the base of window blind guideway 126 is not constant distance, falling with the range indicated by the arrows labeled "min." and "max.". Similarly, the radial distance along radius $R_2$ from pivot point 146 to the inner surface of semi-circular window frame 130 is also not constant, also having a minimum radius at the vertical and a maximum radius at the horizontal. The rate of change of radius $R_1$ and the rate of change of $R_2$, in percentage of their length, is the same as the radii sweep out 180 degrees about pivot point 146.

When pleated blind 110 is in the fully stowed position, slat 138 is slidably forced to the most radially outward position on operating arm 144 due to engagement of blind first, inner end 132 and the base end 138*a* of slat 138 with the base surface of window blind guideway 126 of bridge 124. As operating arm 144 commences its rotation in direction B, second outer end 134 of pleated blind 110 rubs against the inner surface of the semi-circular window frame 130. The contact, for example along rub zone 148, between sill and blind forces slat 138, and with it pleated blind 110, radially inwardly, sliding along operating arm 144.

Once past rub zone 148, gravity assists so that first, inner end 132 of blind 110 follows in contact with the base of guideway 126. Thus the blind follows a trajectory defined by a plot of radius R about pivot point 146. When operating arm 144 is rotated over-center, contact between first, inner end 132 and slat 138 against the base of window blind guideway 126, for example along rub zone 149 forces blind 110 radially outwardly into close proximity with the inner surface of semi-circular window frame 130.

Figure 20:
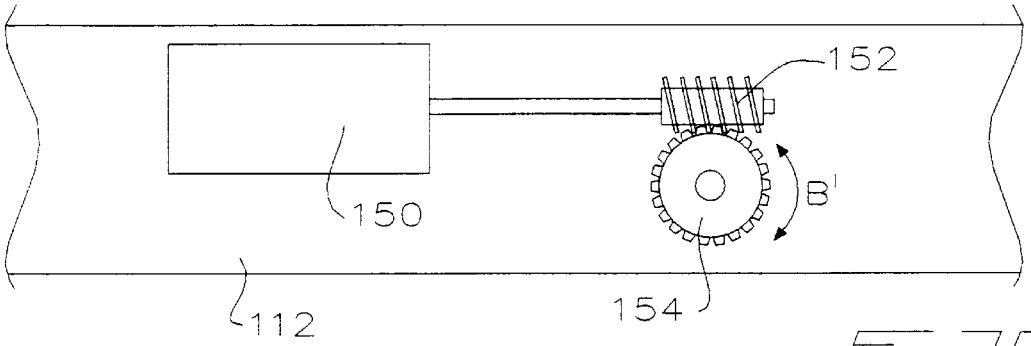
FIG. 20 is in partially cut-away front elevation a motorized drive mechanism for deploying and retracting the arched window blind of FIG. 1.
Figure 21:
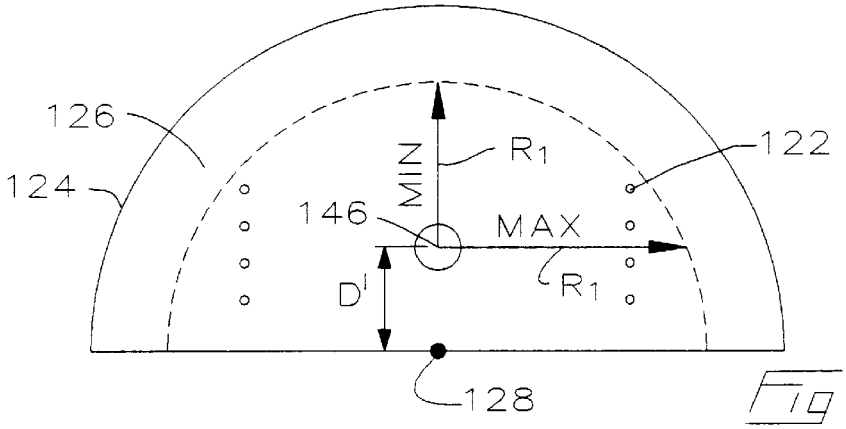
FIG. 21 is in enlarged front elevation, the radial support bridge for the arched window blind of FIG. 1.
Figure 22:
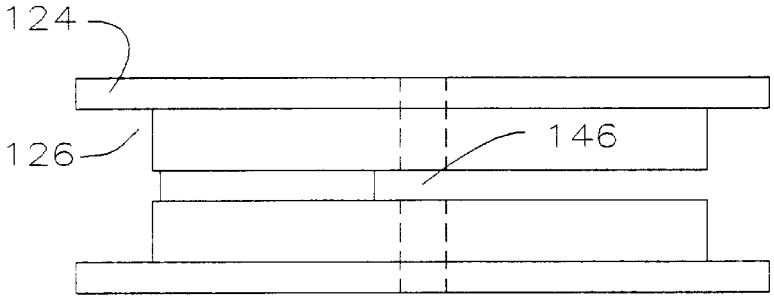
FIG. 22 is in plan view, the radial support bridge of FIG. 21.

As may be seen in FIG. 20, a remote means for operation of blind 110 through an electric motor is shown. Motor 150, mounted to channel 112, rotates worm gear 152 which rotates operating arm 144 about pivot 146 through spur gear 154.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A blind for an arched window wherein said arched window has a semi-circular window frame and a horizontal window sill and wherein said window frame has a center of curvature lying at or below an upper surface of said window sill, said blind comprising:

a base mountable onto said upper surface of said window sill, a pivot mounted onto said base so as to be positionable a first distance, vertically above said center of curvature of said window frame when said base is mounted onto said window sill, an arm pivotably mounted to said pivot so as to be pivotable 180 degrees about said pivot in a vertical plane, said vertical plane intersecting said base, an accordion member collapsible and extendible between a base edge of said accordion member and a leading edge of said accordion member by collapsing into a stowed position and unfolding into a deployed position respectively a folded adjacent array of elements extending between said base edge and said leading edge, said base edge mountable to a first side of said upper surface of said window sill, said first side of said upper surface of said window sill extending between said pivot and a first end of said window frame when said base is mounted to said window sill, said leading edge of said accordion member slidably mounted to said arm so as to be slidable relative to said arm in a radial direction relative to said pivot, an arcuate rigid bridgeway mounted to said base, a bridgeway follower on said accordion member slidable over said bridgeway so as to radially position, along an arcuate trajectory corresponding to the shape of said bridgeway, relative to said pivot and said arm, said leading edge and said folded adjacent array of elements as said and is rotated about said pivot in said vertical plane, wherein as said leading edge follows said arcuate trajectory, a radially outermost end of said leading edge is a maximum radial distance from said pivot when said leading edge is horizontal and is a minimum radial distance from said pivot when said leading edge is vertical, wherein said maximum radial distance is greater than said minimum radial distance by said first distance, whereby said blind may be opened and closed without binding at the apex of said window frame.

2. The blind of claim 1 wherein said accordion member is a pleated blind.

3. The blind of claim 2 further comprising a support mountable to said base for supporting said pleated blind while in said deployed position.

4. The blind of claim 3 wherein said bridgeway is an arcuate track mounted at ends of said track to said base and parallel to said vertical plane, and wherein said bridgeway follower is a rigid member mounted to said leading edge of said pleated blind and extending generally perpendicularly from said vertical plane so as to slidingly engage an end of said rigid member on said track.

5. The blind of claim 4 wherein said base is an elongate channel and said vertical plane intersects said channel along its length.

6. The blind of claim 5 wherein said track also serves as said support.

7. The blind of claim 5 wherein said support is a curved elongate member mountable at its ends to said base.

8. The blind of claim 7 wherein said support is a flexible rod.

9. The blind of claim 5 wherein said channel is a telescopic channel, adjustable so as to abut ends of said channel against said first end of said window frame and against an opposed facing second end of said window frame.

10. The blind of claim 1 wherein said pivot is adjustably positionable vertically on said base.

11. The blind of claim 1 wherein said leading edge further comprises a slot mounted to an adjacent end element in said array so as to be parallel and adjacent said arm.

12. The blind of claim 3 wherein said bridgeway is mounted over said pivot on said base, said bridgeway lying in said vertical plane, and wherein said follower is a radially innermost end of said leading edge and a radially innermost edge of said array of elements, said bridgeway positioned for sliding engagement of said radially innermost end of said leading edge and said radially innermost edge of said array of elements over an upper surface of said bridgeway as said arm is pivoted between said stowed position and said deployed position.

13. The blind of claim 12 wherein said base is an elongate channel and said vertical plane intersects said channel along its length.

14. The blind of claim 13 wherein said track also serves as said support.

15. The blind of claim 13 wherein said support is a curved elongate member mountable at its ends to said base.

16. The blind of claim 15 wherein said support is a flexible rod.

17. The blind of claim 13 wherein said channel is a telescopic channel, adjustable so as to abut ends of said channel against said first end of said window frame and against an opposed facing second end of said window frame.

18. The blind of claim 1 wherein said pivot is adjustably positionable vertically on said base.

19. The blind of claim 1 wherein said leading edge further comprises a slot mounted to an adjacent end element in said array so as to be parallel and adjacent said arm.

20. An arcuately deployable blind for arched frame windows comprising:

a base, a pivot mounted to the base and positionable over a center of curvature of a window frame of said arched frame window, a slide arm, rotatably mounted at a first end to said pivot, an arcuate rigid bridgeway mountable to said base, an arcuately deployable pleated blind, having first and second parallel longitudinal sides and first and second parallel transverse edges, said edges extending generally at right angles to, and contiguous with, said sides, a follower on said pleated blind for sliding engagement over said bridgeway, said first edge of said blind fastened to said base, said second edge of said blind slidably fastened to said slide arm, and an actuator for deploying and retracting said blind.

21. A blind for an arched window wherein said arched window has a semi-circular window frame and a horizontal window sill and wherein said window frame has a center of curvature lying at or below an upper surface of said window sill, said blind comprising:

a base mountable onto said upper surface of said window sill, a pivot mounted onto said base so as to be positionable a first distance, vertically above said center of curvature of said window frame when said base is mounted onto said window sill, an arm pivotably mounted to said pivot so as to be pivotable 180 degrees about said pivot in a vertical plane, said vertical plane intersecting said base, an accordion member collapsible and extendible between a base edge of said accordion member and a leading edge of said accordion member by collapsing into a stowed position and unfolding into a deployed position respectively a folded adjacent array of elements extending between said base edge and said leading edge, said base edge mountable to a first side of said upper surface of said window sill, said first side of said upper surface of said window sill extending between said pivot and a first end of said window frame when said base is mounted to said window sill, said leading edge of said accordion member slidably mounted to said arm so as to be slidable relative to said arm in a radial direction relative to said pivot, a guideway mounted to said base, a guideway follower on said accordion member cooperating with said guideway so as to radially position, along an arcuate trajectory relative to said pivot and said arm, said leading edge and said folded adjacent array of elements as said arm is rotated about said pivot in said vertical plane, wherein as said leading edge follows said arcuate trajectory, a radially outermost end of said leading edge is a maximum radial distance from said pivot when said leading edge is horizontal and is a minimum radial distance from said pivot when said leading edge is vertical, wherein said maximum radial distance is greater than said minimum radial distance by said first distance, whereby said blind may be opened and closed without binding at the apex of said window frame, wherein said accordion member is a pleated blind, further comprising a support mountable to said base for supporting said pleated blind while in said deployed position, wherein said guideway is an arcuate bridgeway mounted over said pivot on said base, said bridgeway lying in said vertical plane, and wherein said follower is a radially innermost end of said leading edge and a radially innermost edge of said array of elements, said bridgeway positioned for sliding engagement of said radially innermost end of said leading edge and said radially innermost edge of said array of elements over an upper surface of said bridgeway as said arm is pivoted between said stowed position and said deployed position.

22. The blind of claim 21 wherein said base is an elongate channel and said vertical plane intersects said channel along its length.

23. The blind of claim 22 wherein said track also serves as said support.

24. The blind of claim 22 wherein said support is a curved elongate member mountable at its ends to said base.

25. The blind of claim 24 wherein said support is a flexible rod.

26. The blind of claim 22 wherein said channel is a telescopic channel, adjustable so as to abut ends of said channel against said first end of said window frame and against an opposed facing second end of said window frame.

* * * * *